United States Patent [19]

Hallberg

[11] 4,456,263

[45] Jun. 26, 1984

[54] TETHERED MISSILE ELEMENT GAME APPARATUS

[76] Inventor: Jack T. Hallberg, 3630 Hueco Ave., El Paso, Tex. 79925

[21] Appl. No.: 447,708

[22] Filed: Dec. 7, 1982

[51] Int. Cl.[3] ..... A63B 67/10

[52] U.S. Cl. ..... 273/393; 273/413

[58] Field of Search ..... 273/40, 393, 413

[56] References Cited

U.S. PATENT DOCUMENTS

| | | | |
|---|---|---|---|
| 148,881 | 3/1874 | Griffin | 273/393 X |
| 1,812,253 | 6/1931 | Bonham | 273/393 X |
| 4,350,344 | 9/1982 | Bear | 273/393 X |

*Primary Examiner*—Anton O. Oechsle
*Attorney, Agent, or Firm*—D. Paul Weaver

[57] ABSTRACT

A multi-sided horizontal platform for the support of object or target balls is supported above the horizontal base of a main pyramid support frame. A single swinging missile ball is connected by a tether to the apex of the main pyramid support frame and during use has its swing interrupted by the apex of an internal smaller pyramid frame whose base and apex are symmetrically arranged relative to the base and apex of the main pyramid frame. Plural players in succession at the sides of the game apparatus elevate and aim the missile ball at opposing players' target balls held on that side of the ball support platform in front of each player. The target balls of each player have a distinct color different from those of other players and the target balls are arranged alternately on the sides of the support platform. Each platform side also supports one black ball which, when knocked off by a player, results in a penalty.

11 Claims, 7 Drawing Figures

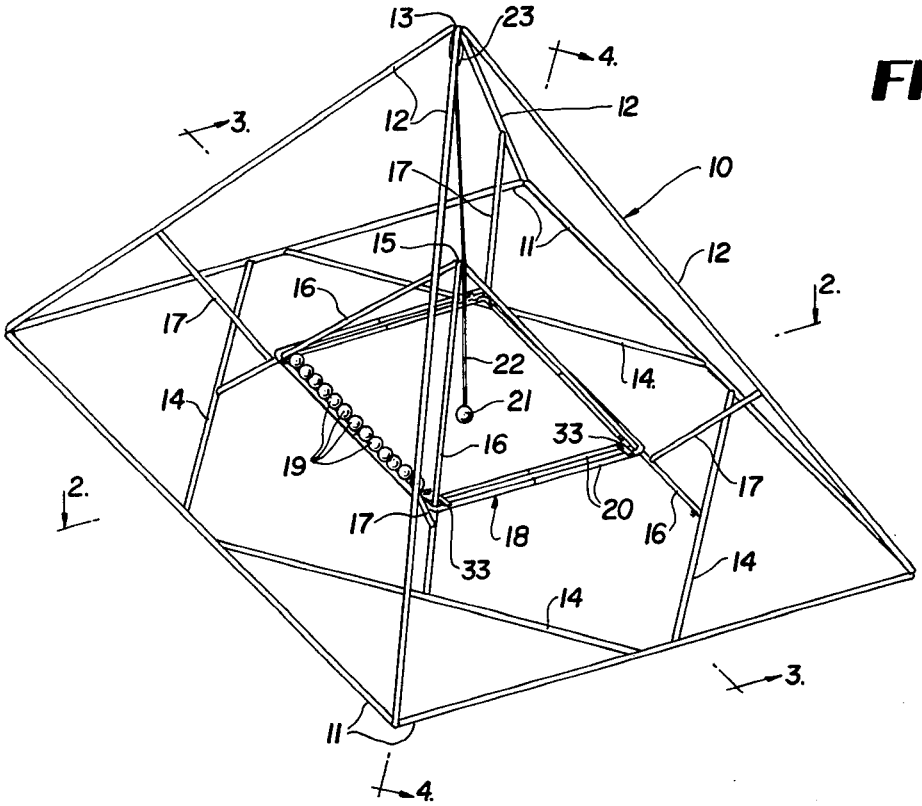
FIG. 1
FIG. 2
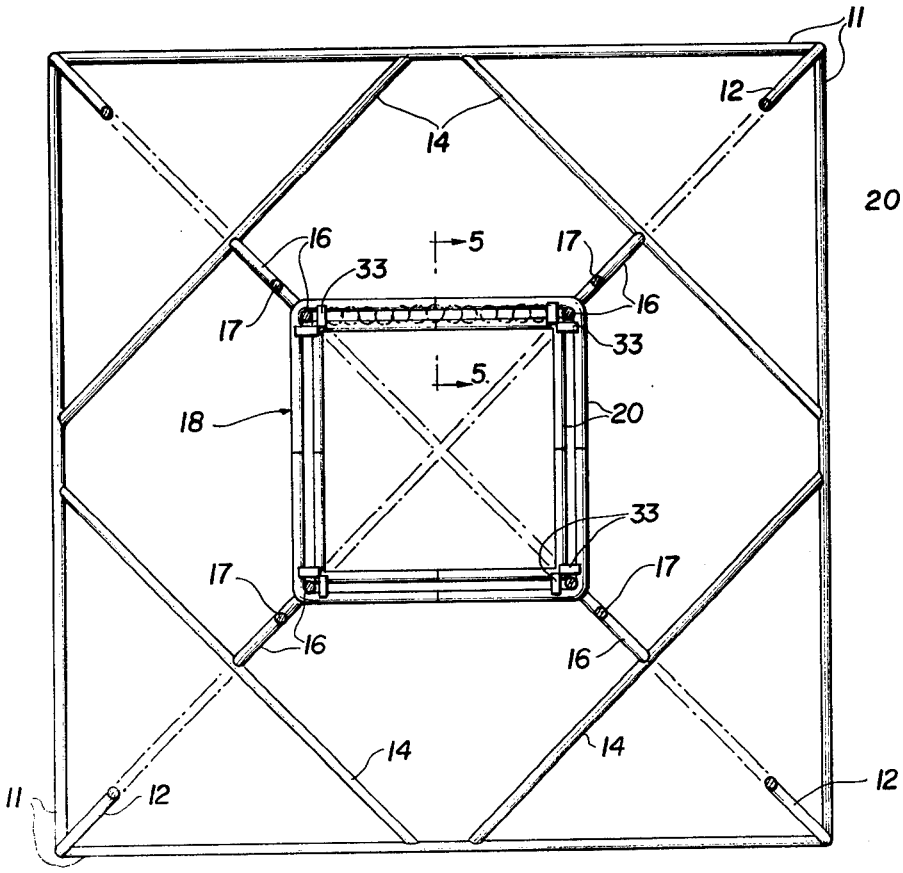
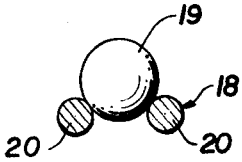
FIG. 5

TETHERED MISSILE ELEMENT GAME APPARATUS

BACKGROUND OF THE INVENTION

Games consisting of supported target pieces, such as balls, and a tethered missile piece to be aimed and swung at an opposing player's target pieces are known in a number of forms.

The objective of this invention is to provide a game apparatus of this general character which is more interesting and entertaining in its construction and mode of use than any known prior art apparatus.

A further object of the invention is to provide a game apparatus of the mentioned type which has a striking and unique three dimensional appearance and construction resulting in an equally unique and interesting mode of operation, requiring a degree of skill and attention on the part of players.

A further object is to provide a game apparatus which may be played by one or more players up to the number of players corresponding to the number of sides of the apparatus or two times the number of sides, if desired.

Still another object of the invention is to provide a tethered swinging ball game apparatus whose basic construction is in the form of a pyramid, either three sided or four sided, and wherein a level multi-sided support for object or target balls is disposed interiorly and centrally of the exterior main pyramid frame at an elevation above and parallel to the base plane of the latter.

Another object is to provide a game apparatus of the character described whose supporting framework can be constructed entirely from rod stock of one diameter made from various convenient materials.

Other features and advantages of the invention will become apparent to those skilled in the art during the course of the following description.

BRIEF DESCRIPTION OF THE DRAWINGS

FIG. 1 is a perspective view of a game apparatus in accordance with one preferred embodiment.

FIG. 2 is an enlarged horizontal section taken on line 2—2 of FIG. 1.

FIG. 5 is an enlarged fragmentary vertical section taken on line 5—5 of FIG. 2.

DETAILED DESCRIPTION

Figure 6:
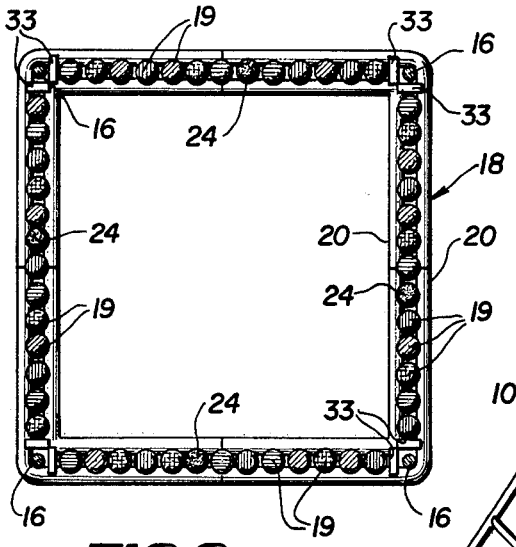
FIG. 6 is an enlarged plan view of a rectangular horizontal support platform for object or target balls of the players.

Referring to the drawings in detail wherein like numerals designate like parts, a game apparatus as depicted in FIGS. 1 through 6 comprises a main exterior pyramid support frame 10 having a square base formed of connected horizontal rods 11 and four triangular sides formed by upwardly converging rods 12 joined at their tops to form an apex 13 for the main pyramid frame 10. The rod stock used to construct the game apparatus may be metal, wooden or plastics and it may all be of one uniform size for economy of manufacturing.

Horizontal diagonal brace rods 14 are connected across the corners of the square pyramid base by attachment to the base rods 11. An interior smaller symmetrically arranged pyramid frame having an apex 15 directly below and in vertical alignment with the main apex 13 is formed by upwardly convergent rods 16 whose lower ends are attached to the midpoints of horizontal rods 14. Comparatively short brace rods 17 interconnect the parallel convergent rods 12 and 16 of the main and interior pyramid frame structures. The rods 17 impart rigidity to the framework and also form visual guides between which the tethered missile ball, yet to be described, must pass in the proper playing of the game according to prescribed rules.

A horizontal rectangular stationary support frame 18 for a multiplicity of equal size variously-colored object or target balls 19 for the various players is arranged at an elevation above the horizontal base of main pyramid frame 10. This platform consists of a pair of spaced parallel rods 20 forming a support gutter for the target balls 19 extending around the four sides of the square platform. The interior upwardly convergent rods 16 pass between the platform rods 20 at the four corners of the platform and are suitably fixed to the platform to firmly support it.

A swinging missile ball 21 attached to a tether 22 is employed by players to strike the target balls 19 of opposing players and knock such balls off of the platform 18, while avoiding the striking of the balls belonging to the particular player who is using the missile ball. The tether 22 is attached as by a loop 23 to the apex 13 of the main pyramid frame. The length of the tether is such that when the missile ball 21 is at rest with the tether positioned substantially vertically, FIG. 3, the ball 21 has its center disposed substantially at the elevation of the top horizontal plane defined by support platform 18. This enables the missile ball 21, when swinging from an elevated position such as shown in broken lines in FIG. 3, to strike the target balls 19 of opposing players along the side of the rectangular platform 18 nearest to the particular player utilizing the missile ball 21 and to knock the target balls 19 of opposing players out of the adjacent gutter defined by the two rods 20 of the platform 18. A net, not shown in the drawings, can be suspended directly under the rectangular ball support platform 18 to recover the target balls 19 as they are dislodged by the missile ball 21 from the platform 18. This recovery net is an optional feature of the apparatus which can be omitted. Without the net, dislodged balls 19 will tend to remain inside of the areas defined by the base rods 11 and 14.

Figure 3:
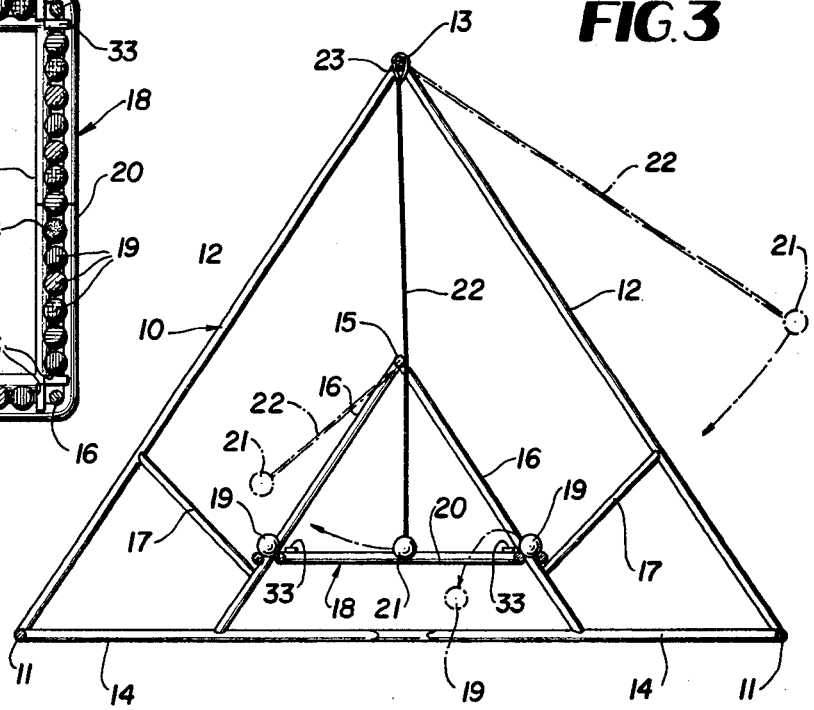
FIG. 3 is a vertical section taken on line 3—3 of FIG. 1.

As the missile ball 21 strikes a target ball 19 on its downward swing as depicted in FIG. 3, the geometry of the apparatus including the length of the tether 22 allows the missile ball 21 to clear the rods 20 of platform 18 without striking the platform. Immediately after passing over the rods 20 at the near side of the platform 18, the swinging tether 22 will have its swing arrested and shortened by the internal apex 15, as best shown in FIG. 3. This assures that the tethered missile ball 21 will not strike the target balls 19 on the far side of the support platform 18 in relation to that side of the apparatus where a given player using the missile ball 21 is situated. The engagement of the tether 22 with the apex 15 also reduces the time required for the missile ball to assume a neutral position after a strike or miss in the playing of the game.

While the rules of play may be varied somewhat to meet the desires of various players, the preferred and recommended manner of playing the same is as follows.

When four players are using the four-sided apparatus shown in FIGS. 1–6, each player is given three identical object or target balls in one color, such as yellow, red, blue and brown. Each player is also given a single black ball 24, FIG. 6. On each side of the platform 18 the target balls of the several players are arranged in alternating relationship, beginning at the left hand end of each platform side with the color designated for the player who is situated at that side of the apparatus. The black ball 24 of each player is positioned as shown in FIG. 6 immediately after the fifth ball beginning from the left hand end of one row of target balls. Including the black balls 24, therefore, there will be a total of thirteen balls supported in a straight row along each side of the rectangular platform 18.

The objective of the game is for each player utilizing the missile ball 21 in proper order to strike and knock off of the platform 18 the colored balls of his three opponents which are positioned in the row along that side of the platform 18 immediately facing him or her. The winner of the game, therefore, is that player who has a colored ball remaining on the platform 18 after all opponents' colored balls 19 have been knocked off.

After each player uses the missile ball 21 for one swing at an opponent's target ball, whether a hit or a miss, the missile ball is then passed to the player immediately to the right, and this sequence is followed until the game is over. If any player strikes and knocks off the black ball 24, a penalty is imposed, such as removing from the support platform one of his or her object or target colored balls. The black ball is then relocated on the support to provide a further penalty producing hazard during continued play.

When the missile ball 21 is being used, it is required to be raised to a specified elevation, such as a few inches, above the inclined plane defined by one side of the main pyramid frame, FIG. 3, and this distance will vary depending upon the size of the apparatus which may vary.

When the missile ball is aimed at an opponent's colored ball near either end of the row of target balls, the missile ball when released must pass between the adjacent pair of inclined rods 12 and also between the adjacent pair of brace rods 17 which serve as visual guides for the players. If desired, the rods 17 may be of a different color from the other rods forming the framework but this is an optional feature which need not be employed.

Figure 7:
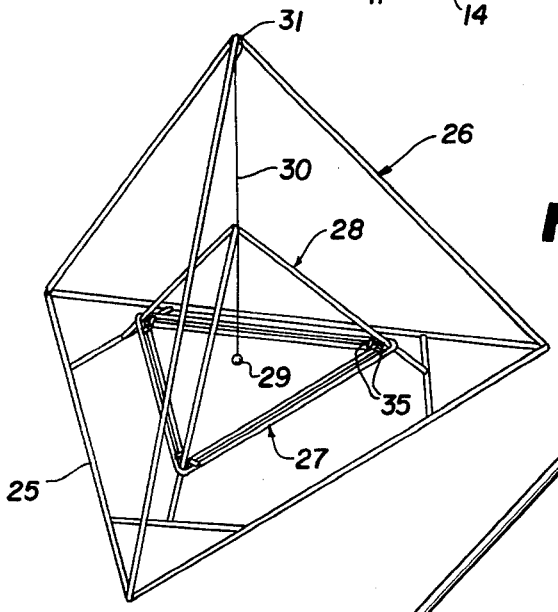
FIG. 7 is a perspective view of a game apparatus according to a second embodiment.
Figure 4:
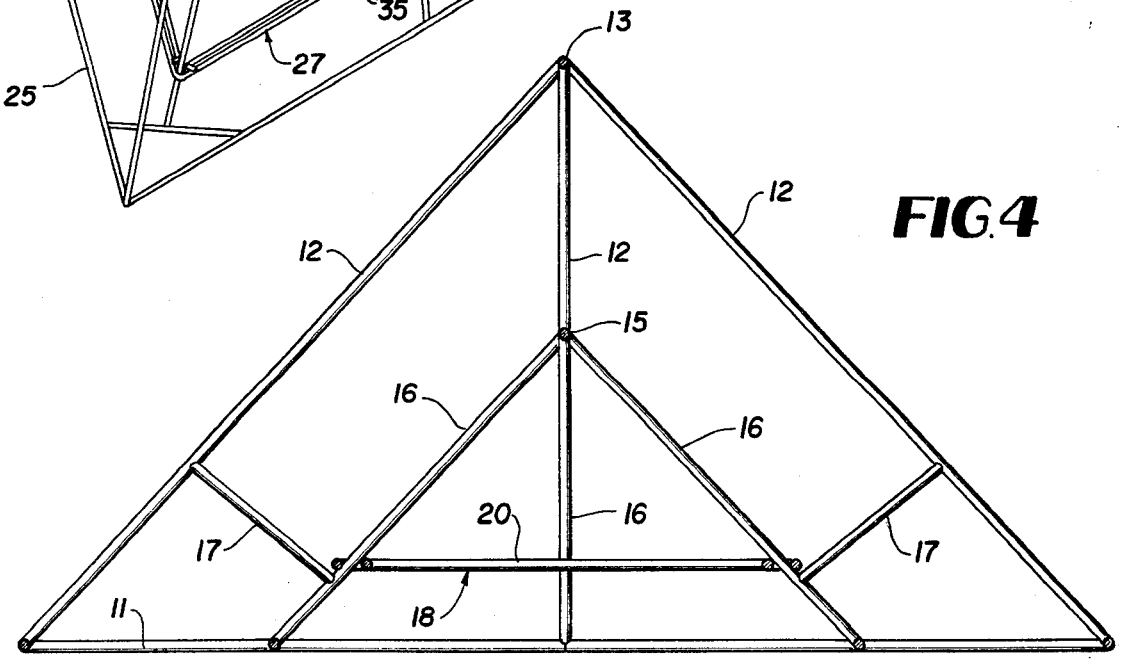
FIG. 4 is a vertical section across corners of the device taken on line 4—4 of FIG. 1.

FIG. 7 shows a second embodiment of the game apparatus which differs from the preferred embodiment in FIGS. 1 through 6 only in that the base 25 of the rod constructed pyramid main frame 26 is triangular rather than square. Likewise, the elevated horizontal support platform 27 for the colored target balls is triangular, as is the interior smaller pyramid rod frame 28. A missile ball 29 of proper size connected to a tether 30 of proper length attached to the main apex 31 is utilized in the same manner described previously with respect to the preferred embodiment.

In the triangular embodiment, the game is played by one, two, three or six players, rather than one, two, three, four or eight players, as described previously. Instead of a total of thirteen target balls along each row on the support frame 18, a total of ten target balls including one black ball will be placed in each row on the triangular support frame or platform 27. The rules of play are generally the same as previously described and it is thought to be unnecessary to repeat the mode of use of the game depicted in FIG. 7 to enable a proper understanding of the invention.

In both embodiments of the invention, FIGS. 1 and 7, stop elements 33 and 35 are fixed at opposite ends of each side of the target ball platforms to avoid direct contact of the balls with the corner inclined support rods for the platforms. If such contact were allowed to take place and the missile ball happened to strike the rods 16, etc., a target ball could be displaced from the platform, whereas it is intended to have the target balls displaced only when directly struck by the missile ball.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A game apparatus comprising a pyramid main frame constructed of rods and having a polygonal base and an apex, a support platform for target balls spaced above and parallel to said base and having plural sides corresponding in number to the sides of the polygonal base and defining a support for rows of target balls, rods supporting said support platform within the pyramid frame and defining inside of the pyramid frame symmetrically therewith a smaller pyramid frame having an apex below and in vertical alignment with the first-named apex, and a missile element including a tether connected with the first-named apex and extending below the elevation of the second-named apex, whereby the missile element may be swung by players positioned near the sides of the apparatus toward the rows of target balls on the support platform to dislodge the same from the support platform in the playing of a game.

2. A game apparatus as defined in claim 1, wherein said polygonal base is a square base and the support platform is square and defines four right angular gutters for four rows of target balls.

3. A game apparatus as defined in claim 1, wherein said polygonal base is triangular and the support platform is triangular and congruent with respect to the base and defines three gutters for three rows of target balls.

4. A game apparatus as defined in claim 1, and the support platform comprising a pair of substantially continuous spaced parallel rods defining gutters for rows of target balls on the support platform.

5. A game apparatus as defined in claim 4, and the rods supporting the support platform within the pyramid frame and defining said small pyramid extending through and above and below corner spaces of the support platform and being attached to the rods of the support platform.

6. A game apparatus as defined in claim 5, and braces for the game apparatus constituting sighting means for the tethered missile element connected between the rods of the pyramid main frame and the rods defining said smaller interior pyramid frame.

7. A game apparatus as defined in claim 1, and the missile element comprising a ball.

8. A game apparatus as defined in claim 1, and target balls for each player of the game including an equal number of balls in one distinct color for each player and one penalty ball of a common color for each player differing from the colors of the balls of all of the players.

9. A game apparatus as defined in claim 8, and all of the target balls for all players having equal sizes and masses.

10. A game apparatus comprising a pyramid framework having a base, a polygonal support platform for rows of target elements spaced above and parallel to the base, frame elements supporting said platform inside of the polygonal framework centrally thereof and extending above the platform to form within the pyramid framework an arresting structure for a tethered missile element, and a swinging tethered missile element whose tether is attached to the apex of the pyramid framework and extends substantially below the level of the arresting structure with the missile element disposed at an elevation to strike target elements in the rows along the sides of the platform for dislodging the target elements without striking the platform.

11. A game apparatus as defined by claim 10, and the base of the pyramid framework and support platform being rectangular with the sides of the support platform in parallel relationship to the sides of the base and the tether arresting structure in vertical coaxial alignment with the apex of the pyramid framework.

* * * * *